US012358709B2

(12) United States Patent
Rice et al.

(10) Patent No.: US 12,358,709 B2
(45) Date of Patent: Jul. 15, 2025

(54) DEVICE FOR DISPENSING A PLURALITY OF FLOWABLE MATERIALS

(71) Applicant: S. C. Johnson & Son, Inc., Racine, WI (US)

(72) Inventors: William J. Rice, Antioch, IL (US); Steven A. Zach, Waterford, WI (US); Francisco R. Figueroa, Milwaukee, WI (US)

(73) Assignee: S. C. Johnson & Son, Inc., Racine, WI (US)

( * ) Notice: Subject to any disclaimer, the term of this patent is extended or adjusted under 35 U.S.C. 154(b) by 225 days.

(21) Appl. No.: 17/771,226

(22) PCT Filed: Nov. 11, 2020

(86) PCT No.: PCT/US2020/059922

§ 371 (c)(1),
(2) Date: Apr. 22, 2022

(87) PCT Pub. No.: WO2021/096902

PCT Pub. Date: May 20, 2021

(65) Prior Publication Data

US 2022/0363465 A1 Nov. 17, 2022

Related U.S. Application Data

(60) Provisional application No. 62/934,252, filed on Nov. 12, 2019.

(51) Int. Cl.
*B65D 81/32* (2006.01)
*B65D 25/56* (2006.01)
(Continued)

(52) U.S. Cl.
CPC ..... *B65D 81/325* (2013.01); *B65D 25/56* (2013.01); *E03D 9/022* (2013.01); *E03D 9/032* (2013.01); *E03D 2009/026* (2013.01)

(58) Field of Classification Search
CPC ..... B65D 83/005; B65D 83/0005; B65D 83/0022; B65D 81/325; B05C 17/00553;
(Continued)

(56) References Cited

U.S. PATENT DOCUMENTS 3,197,071 A * 7/1965 Kuster ..... B65D 81/325 222/105
4,257,267 A * 3/1981 Parsons ..... B01L 3/0234 222/391
(Continued)

FOREIGN PATENT DOCUMENTS

BR 212016010799 U2 8/2016
CN 101218155 A 7/2008
(Continued)

OTHER PUBLICATIONS

Sep. 5, 2023—(JP) Decision of Rejection—App. No. 2022-525791.
Feb. 12, 2021—(WO) International Search Report and Written Opinion—App. No. PCT/US2020/059922.

*Primary Examiner* — Charles P. Cheyney
(74) *Attorney, Agent, or Firm* — Gregory J. Cohan

(57) ABSTRACT

A dispenser for flowable materials includes a tube having a tube interior cavity, an open proximal end, and a distal end having a dispensing orifice. A dividing wall extends along the tube interior cavity and divides the tube into a plurality of chambers. A first flowable material is positioned in a first of the chambers. At least one additional flowable material is positioned in another of the chambers. Each of a plurality of pistons is seated in a proximal end of one of the chambers. A handle includes a plurality of pusher bars, with each pusher bar engaging one of the pistons. When one of the handle and the tube is received in the other of the handle and the tube, the handle and tube move coaxially with respect to
(Continued)

one another, and the pistons force the flowable materials from each of the chambers out of the dispensing orifice.

17 Claims, 5 Drawing Sheets

(51) Int. Cl.
*E03D 9/02* (2006.01)
*E03D 9/03* (2006.01)

(58) Field of Classification Search
CPC ..... B05C 17/00576; B05C 17/00513; B05C 17/00516
USPC ..... 222/137, 386, 145.1, 145.6
See application file for complete search history.

(56) References Cited

U.S. PATENT DOCUMENTS 4,493,436 A * 1/1985 Brokaw ..... B65D 81/325 222/137
4,852,772 A * 8/1989 Ennis, III ..... B05C 17/00576 222/386
5,020,694 A * 6/1991 Pettengill ..... B65D 81/325 401/35
5,386,928 A * 2/1995 Blette ..... A61C 5/64 222/327
5,782,815 A * 7/1998 Yanai ..... A61M 5/28 604/218
5,881,920 A * 3/1999 Seager ..... B65D 81/325 222/137
5,881,921 A * 3/1999 Seager ..... B65D 81/325 222/137
7,520,406 B2 * 4/2009 Jaichandra ..... B65D 83/0005 222/386
8,851,339 B2 * 10/2014 Schultz ..... B65D 83/0005 222/49
9,212,476 B2 * 12/2015 Mühlhausen ..... E03D 9/005
10,286,370 B2 * 5/2019 Vogt ..... A61B 17/8805
10,501,257 B2 * 12/2019 Ruthe-Steinsiek ..... B65D 83/0022
10,807,765 B2 * 10/2020 Pheir ..... B65D 41/04
11,642,193 B2 * 5/2023 Boehm ..... A61C 5/68 433/90
2007/0007302 A1 * 1/2007 Jaichandra ..... B65D 83/0005 222/49
2007/0051750 A1 * 3/2007 Suchan ..... B65D 83/0005 222/137
2007/0164047 A1 * 7/2007 Reidt ..... B65D 47/305 222/137
2008/0054020 A1 * 3/2008 Pierson ..... B65D 83/68 222/145.6
2011/0017406 A1 * 1/2011 Schultz ..... E03D 9/022 156/538
2014/0339260 A1 11/2014 Muhlhausen et al.

FOREIGN PATENT DOCUMENTS

CN 102858650 A 1/2013
CN 103717811 A 4/2014
DE 202004011775 U1 10/2004
EP 2419349 A1 2/2012
FR 1470125 A 2/1967
GB 2483517 A 3/2012
JP 2009500254 A 1/2009
JP 2011513509 A 4/2011
WO 2007008531 A1 1/2007
WO 2019189056 A1 10/2019

* cited by examiner

DEVICE FOR DISPENSING A PLURALITY OF FLOWABLE MATERIALS

CROSS-REFERENCE TO RELATED APPLICATIONS

This application is a U.S. National Stage application under 35 U.S.C. § 371 of International Application PCT/US2020/059922 (published as WO/2021/096902 A1), filed Nov. 11, 2020, which claims the benefit of priority to U.S. provisional patent application No. 62/934,252, filed Nov. 12, 2019. Benefit of the filing date of these prior applications is hereby claimed. Each of these prior applications is hereby incorporated by reference in its entirety.

FIELD

Aspects of this disclosure relate to a device for dispensing flowable materials and more particularly, to a device for dispensing a plurality of flowable materials of different colors.

BACKGROUND

Dispensers or applicators for depositing flowable materials can be used in toilet bowls to provide cleaning and/or disinfectant and/or fragrancing in the toilet bowl. A dollop of the flowable material, which may be a gel or adhesive gel, can be applied from a suitable dispenser directly onto the inner surface of the toilet bowl, to which the substance adheres. The substance may remain on the inner surface of the toilet bowl even after being contacted with flush water, and typically the substance is only flushed away completely after a large number of flushes. The substance is also suitable for application to other surfaces such as urinals, lavatory or industrial sinks, showers, bathtubs, dishwashing machines and the like.

Particular objects and advantages will be apparent to those skilled in the art, that is, those who are knowledgeable or experienced in this field of technology, in view of the following disclosure and detailed description of certain embodiments.

SUMMARY

In accordance with a first aspect, a dispenser for flowable materials includes a tube having a tube interior cavity, an open proximal end, and a distal end having a dispensing orifice. A dividing wall extends along the tube interior cavity and divides the tube into a plurality of chambers. A first flowable material is positioned in a first of the chambers. At least one additional flowable material is positioned in another of the chambers. Each of a plurality of pistons is seated in a proximal end of one of the chambers. A handle includes a plurality of pusher bars, with each pusher bar engaging one of the pistons. When one of the tube and the handle is received in the other of the tube and the handle, the tube and handle move coaxially with respect to one another, and the pistons force the flowable materials in unison from each of the chambers out of the dispensing orifice.

In accordance with another aspect, a dispenser for flowable materials includes a substantially cylindrical tube having an interior cavity, an open proximal end and a distal end having a dispensing orifice. A dividing wall is positioned in the tube and is connected along opposed sides thereof to an interior surface of the tube, dividing the tube into a plurality of chambers. A first flowable material has a first color and is positioned in a first of the chambers. At least one additional flowable material having another color different than the first color is positioned in another of the chambers. Each of a plurality of pistons is slidingly positioned in a proximal end of one of the chambers. A handle includes a proximal end, and open distal end, a handle interior cavity that receives the tube, and a plurality of pusher bars. Each pusher bar is connected to the proximal end of the handle and has a free distal end, with the distal end engaging one of the pistons. When the tube is received in the handle and the tube and handle move coaxially with respect to one another, the pistons force the flowable materials from each of the chambers out of the dispensing orifice.

These and additional features and advantages disclosed here will be further understood from the following detailed disclosure of certain embodiments, the drawings thereof, and from the claims.

BRIEF DESCRIPTION OF THE DRAWINGS

The foregoing and other features and advantages of the present embodiments will be more fully understood from the following detailed description of illustrative embodiments taken in conjunction with the accompanying drawings in which.

Figure 1:
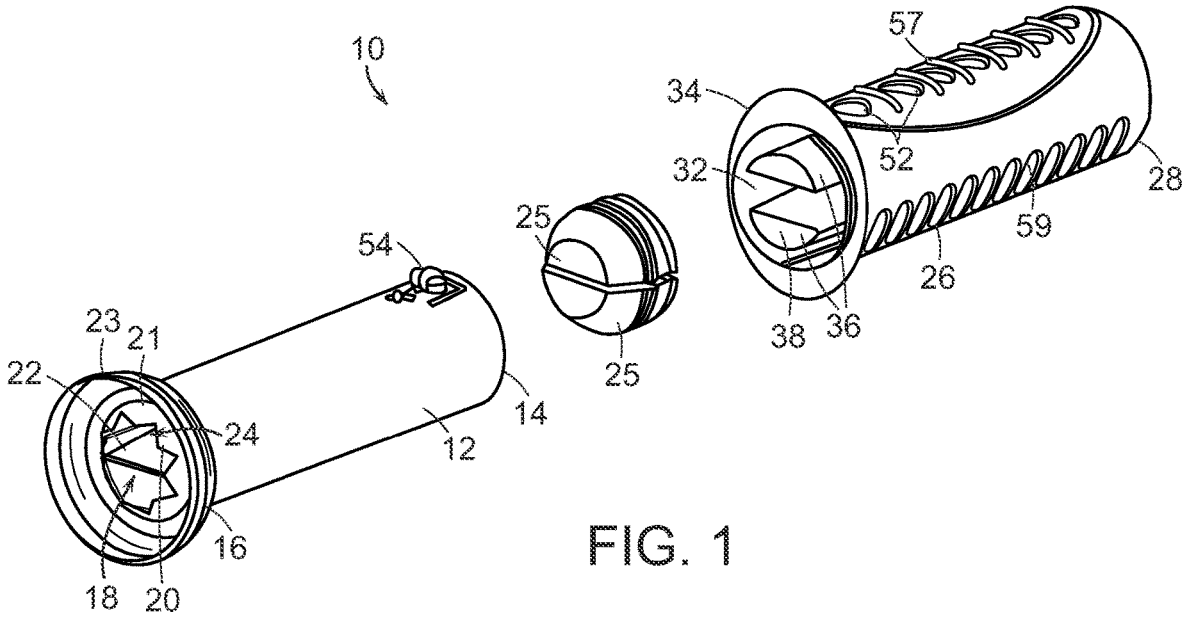
FIG. 1 is an exploded perspective view of a dispenser for dispensing a flowable material.

The figures referred to above are not drawn necessarily to scale, should be understood to provide a representation of particular embodiments, and are merely conceptual in nature and illustrative of the principles involved. Some features of the dispenser depicted in the drawings have been enlarged or distorted relative to others to facilitate explanation and understanding. The same reference numbers are used in the drawings for similar or identical components and features shown in various alternative embodiments. Dispensers for flowable materials as disclosed herein would have configurations and components determined, in part, by the intended application and environment in which they are used.

The term "substantially" as used herein is meant to mean mostly, or almost completely, within the constraints of sensible commercial engineering objectives, costs, manufacturing tolerances, and capabilities in the field of dispensers for flowable materials. Similarly, the term "approximately" as used herein is meant to mean close to, or about a particular value, within the constraints of sensible commercial engineering objectives, costs, manufacturing tolerances, and capabilities in the field of dispensers for flowable materials.

DETAILED DESCRIPTION OF EMBODIMENTS

Referring to FIG. 1, a dispenser 10 for dispensing flowable materials is shown. In certain embodiments, the flowable materials may be gels, and, more particularly adhesive gels. The gels may provide cleaning and/or disinfectant and/or fragrancing for a toilet bowl when dispensed therein by dispenser 10. An exemplary adhesive gel is disclosed in U.S. Pat. No. 6,667,286, the entire disclosure of which is incorporated herein by reference. The gels may also be colored as described in greater detail below.

Dispenser 10 may include a tube 12 having a proximal end 14 and a distal end 16 and defines a tube interior tube interior cavity 18. Flowable materials (not shown here), such as gels, may be contained within tube interior cavity 18. Tube 12 may be substantially cylindrical in shape, and in one example, the tube has a circular cross-section. Yet it is contemplated that the tube can various different cross-sectional shapes, such as square, circular, rectangular, square, oval, star, triangular, and other odd and even sided polynomials and various portions thereof.

Distal end 16 of tube 12 may include a dispensing orifice 20 formed in an end wall 21 of tube 12, through which the gels exit dispenser 10. In certain embodiments, end wall 21 is convex extending outwardly. The end wall 21 can have a star shaped orifice 20, which forms the gel dollop as it exits the tube. Yet any orifice shape is contemplated for forming the dollops into the desired shape, e.g. rectangular, circular, oval, even and odd sided polynomials, etc. In certain embodiments, tube 12 may include an outwardly flaring shroud 23 that surrounds orifice 20.

A dividing wall 22 may extend along interior tube interior cavity 18 and divides the singular interior tube interior cavity 18 into a plurality of chambers 24 of substantially the same size, which can receive different types of gel e.g. color, cleaning and/or disinfectant and/or fragrancing. In this example, the divider wall has a first side and a second side, and a first gel type is placed on the first side and a second gel type is placed on the second side. In this way, the different gels can share a common dividing wall 12 or barrier. In this way, the gels can be placed into the same or a singular tube, and separate dispensing structures are not required and, therefore, a more compact design is formed.

In the illustrated embodiment, dividing wall 22 is formed of a single substantially planar and rectangular wall that extends along interior tube interior cavity 18 of tube 12 from distal end 14 to proximal end 16. The dividing wall 22 is connected at opposite sides thereof to an interior surface of tube 12. The dividing wall 22 is also centrally located in the interior tube interior cavity 18. In this example, the length of the dividing wall 22 is approximately equal to the length of the tube 12 and the width of the dividing wall 22 is approximately equal to the diameter of the tube 12.

In the illustrated embodiment, dividing wall 22 divides interior tube interior cavity 18 into two chambers 24 of approximately the same size, each of which is substantially hemispherical in cross-section. Yet, it can be understood that various cross-sectional shapes are contemplated for the internal portions of the chambers which includes and is not limited to circular, rectangular, square, oval, star, triangular, and other odd and even sided polynomials and various portions thereof.

Each of a plurality of pistons 25 is seated in a proximal end of a corresponding chamber 24, thereby sealing the gels within chambers 24 and preventing the gels from drying up during shipment and storage. In the illustrated embodiment, there are two pistons 25, each of which is seated within one of the two chambers 24. In the illustrated embodiment, pistons 25 are substantially hemispherical in cross-section in order to mate with the substantially hemi spherically shaped chambers 24 within which they are seated. But again any suitable cross-sectional shape is contemplated to correspond with the cross-sectional shapes of the chambers, which may include and is not limited to circular, rectangular, square, oval, star, triangular, and other odd and even sided polynomials and various portions thereof. The pistons can also have a tapered profile and when positioned together can approximate a frusto-conical shape. This profile may assist the ability of the pistons to push the gels out of the chambers 24.

The components of dispenser 10 may be formed of polymeric materials such as translucent or opaque polyethylene or polypropylene. Other suitable materials for dispenser 10 will become readily apparent to those skilled in the art, given the benefit of this disclosure. In certain embodiments, pistons 25 may be formed of low-density polyethylene ("LDPE"), high-density polyethylene ("HDPE"), or polypropylene ("PP"). Other suitable materials for pistons 25 will become readily apparent to those skilled in the art, given the benefit of this disclosure. In one example, the components of the dispenser 10 can be formed by injection molding, additive manufacturing, or casting.

Dispenser 10 may include a handle 26 that cooperates with tube 12 to dispense the gels from chambers 24 out through orifice 20. Handle 26 may have a proximal end 28, a distal end 30, and a handle interior cavity 32 that receives distal end 14 of tube 12. A flange 34 may be formed about a periphery of distal end 30. In certain embodiments an outer diameter of flange 34 may be approximately equal to an outer diameter of shroud 23.

Handle 26 may include a plurality of pusher bars or plungers 36 that are connected to the proximal end of the handle 26 and extend along handle cavity 32 to free ends 38 thereof at distal end 30 of handle 26. The free ends 38 of pusher bars 36 engage pistons 25. In another example, however, the pusher bars 36 could be formed integral with the pistons 25 or the pistons could be omitted altogether. In the illustrated embodiment, handle 26 includes two pushier bars 36, each of which engages one of the two pistons 25 and has a substantially hemispherical cross-section. But the cross-sections of the pusher bars can be formed in any shape to correspond with the cross-sections of the pistons 24 and the cross-sections of the chambers. In certain embodiments, each piston 25 may have a recess 27 (seen in the embodiment illustrated in FIG. 8) on its proximal end into which the free end 38 of a pusher bar 36 is received and provides for the proper alignment with the pusher bar and the pistons. It is also contemplated that the recesses 27 of the pistons 25 could be sized slightly smaller than the free ends 38 of the pusher bars 36 to obtain an interference-type fit between the pusher bars 36 and the pistons 25.

In operation, proximal end 14 of tube 12 is received in distal end 30 of handle 26 and tube 12. The user then places distal end 16 of tube 12 against the inside wall of a toilet bowl, and the handle 26 is pushed toward distal end 16 of tube 12. The movement of pusher bars 36 and pistons 25 toward distal end 16 of tube 12 pushes the gels from chambers 24 out of orifice 20 in unison to form a dollop 39, seen in FIG. 6. As handle 26 is moved, pistons 25 engage and are limited by the surfaces of chambers 24 and dividing wall 22 and slide therealong, ensuring good removal of the gels from chambers 24. One example dispenser with a tube and handle slidingly disposed with respect to one another is disclosed in U.S. Pat. No. 7,520,406, the entire disclosure of which is incorporated herein by reference.

Figure 3:
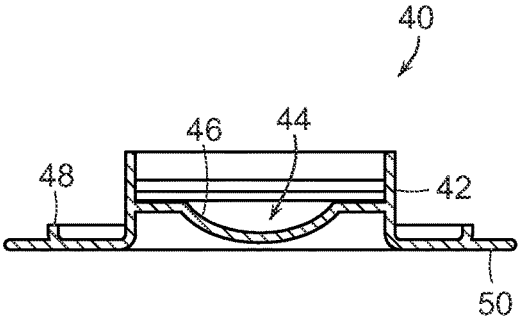
FIG. 3 is a section view of a cap of the dispenser of FIG. 1.

In certain embodiments, a cap 40 may be provided to seal distal end 16 of tube 12 during shipping, storage and between uses of dispenser 10. As seen in FIG. 3, cap 40 may include an upwardly extending circular wall 42 that forms a well 44 with a concave lower inner surface 46 that substantially conforms to the concave outer surface of the end wall 21 of tube 12. This provides a tight seal between cap 40 and tube 12. A rib 48 may extend upwardly about a periphery of cap 40, with shroud 23 of tube 12 being seated between wall 42 and rib 48. A pair of opposed ears 50 may be provided on cap 40 for ease of removal of cap 40 from tube 12. Cap 40 may also be sized for engagement in a docking station that rests on a surface such as a floor.

In certain embodiments it may be desirable to provide metered dosing of the gels out of orifice 20. Handle 26 may include a row of apertures 52 extending axially along handle 26. A guide pin 54 or detent may be provided proximate proximal end 14 of tube 12. Guide pin 54 may extend outwardly from an exterior surface of tube 12 in spring-loaded fashion, and be configured to be sequentially received in different apertures 52 as handle 26 moves coaxially with respect to tube 12. It is to be appreciated that in certain embodiments another mating pin 54 and row of apertures 52 may be positioned on tube 12 and handle opposite the set seen here. In this way, the tube 12 can be positioned in the handle 26 in two positions 180 degrees from each other.

Figure 4:
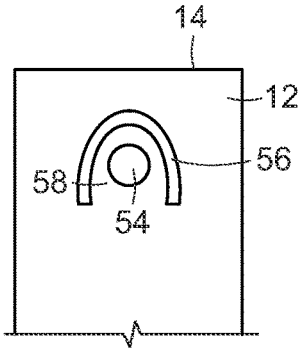
FIG. 4 is a plan view, partially broken away, of the tube of the dispenser of FIG. 1, showing a guide pin positioned on a cutout tab.

As seen in FIG. 4, in certain embodiments, a substantially U-shaped slot 56 may be formed in tube 12 proximate proximal end 14, thereby defining a cutout tab 58. The cutout provides a certain degree of flexibility to the cutout tab. And, guide pin 54 extends outwardly from tab 58 and is biased outwardly in spring-loaded fashion due to cutout tab 58.

In certain embodiments, handle 26 may be provided with gripping surfaces for the user to facilitate the user's ability to grasp the handle 26 during use. In certain embodiments the gripping surfaces take the form of a plurality of ridges 57 and grooves 43 formed on and in, respectively, the exterior surface of handle 26. Nodules and texturing along the handle is also contemplated to increase the user's ability to grasp the handle during use.

In operation, before proximal end 14 of tube 12 is inserted into handle 26, guide pin 54 is aligned with the row of apertures 52 and then depressed. Proximal end 14 of tube 12 is then inserted into distal end 30 of handle 26 as discussed above. Distal end 16 of tube 12 is then placed in contact with the inside wall of a toilet or other surface desired to be cleaned, and handle 26 is pressed in toward the toilet coaxially with respect to tube 12. This action forces pusher bars 36 and, therefore, pistons 25 toward distal end 16 of tube 12, and forces the gels in chambers 24 toward distal end 16 and out of orifice 20. Handle 26 is moved toward distal end 16 of tube 12 until guide pin 54 reaches the most distal aperture 52. At this point guide pin 54 will pop outwardly through the most distal aperture 52, and a predetermined amount of the gels from chambers 24 will have been dispensed through orifice 20 to form a contiguous dollop 39 (seen in FIG. 6) that will be seated on the inside wall of the toilet. Such indexed positioning of tube 12 with respect to handle 16 ensures metered dosing of the gels so that dollops 39 have a uniform and consistent shape and size. It is to be appreciated that any number of apertures 54 may be provided along handle 26 to produce a desired number of doses of gel. Also when pin 54 pops outwardly into position in an aperture 54, a clicking sound may be heard, which can provide an audible signal to the user the dose has been completed.

Figure 5:
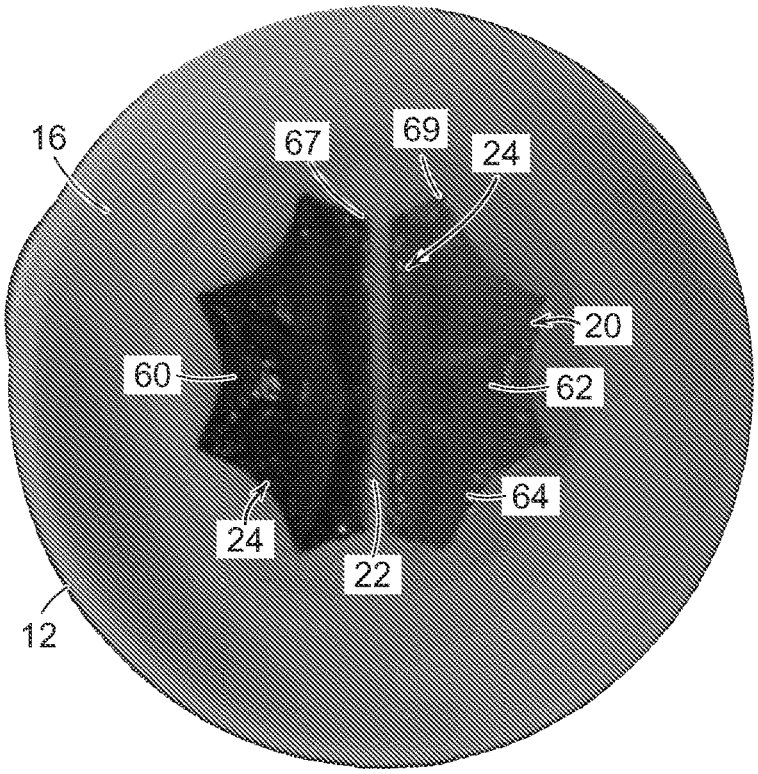
FIG. 5 is an end view of the dispenser of FIG. 1 shown dispensing two flowable materials.

As illustrated in FIG. 5, a first gel 60 is shown being dispensed from one chamber 24 and a second gel 62 is shown being dispensed from the other chamber 24. In certain embodiments, first gel 60 may have a first color and second gel 62 may have a second color that is different than the first color. It is to be appreciated that first gel 60 and second gel 62 may also have different cleaning, disinfecting, and/or fragrancing characteristics as well.

Figure 6:
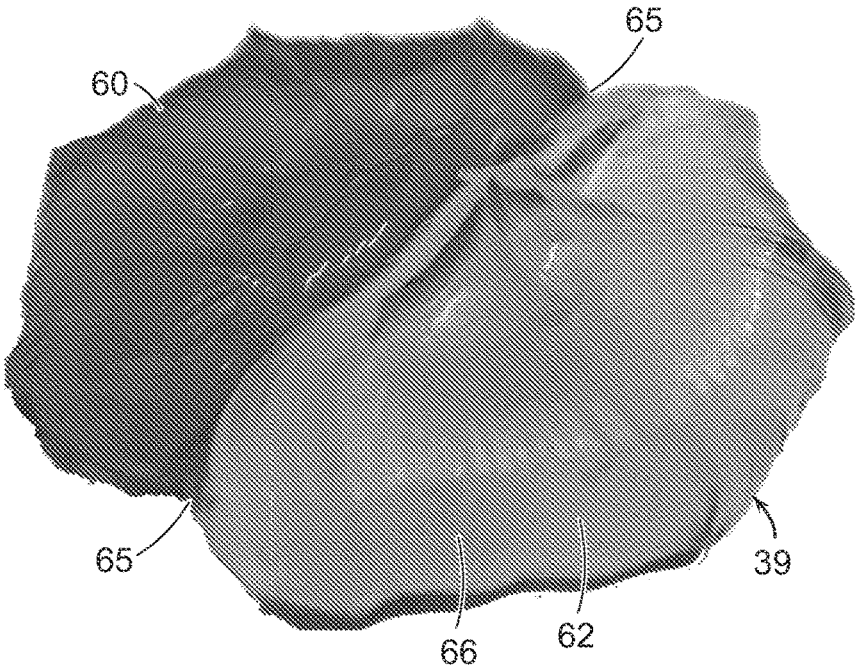
FIG. 6 is a perspective view of a dollop of flowable material dispensed by the dispenser of FIG. 1.

As seen in FIG. 6, dollop 39 is formed with first gel 60 having the first color and second gel 62 having the second color. By providing the gels in different chambers and forming a contiguous dollop from the gels, the visually distinct color scheme of the different gels can be retained when the dollop is seated in the toilet bowl. Since the gels can be differentiated by color, the separate cleaning, disinfecting, and/or fragrancing benefits of the different gels can be visually communicated to the user as a point of difference compared to a single color dollop.

In certain embodiments, as illustrated in FIG. 5, a perimeter of orifice 20 may be formed of a plurality of segments 64 to form a star shape. In the illustrated embodiment, segments 64 are concave extending inwardly toward a center of orifice 20. Concave segments 64 provide dollop 39 with an aesthetically pleasing star shape with scalloped edges 66. It is to be appreciated that orifice may have alternative shapes such as circular, oval, ellipse, or polygonal both of even number of sides and odd number of sides.

In certain embodiments, as illustrated in FIG. 5, dividing wall 22 may be oriented so that it intersects at a central point of each of a pair of opposed concave segments 64. By positioning dividing wall 22 at the central point of opposed concave segments 64, rather than at the ends of concave segments, for example, indentations 65 may be formed in dollop 39 at the junction between first gel 60 and second gel 62, as seen in FIG. 6, which is especially aesthetically advantageous when first gel 60 and second gel 62 have different colors. Indentations 65 can also provide the dollop 39 with different shapes and configurations. It is contemplated that the partition wall 22 may have different shapes and configurations, e.g. curved, elliptical, square, triangular, as well as other shapes, to provide the desired indentations 65 on the dollop.

Additionally, intentionally aligning the partition or dividing wall 22 with a feature of the shape formed in the end wall of the dispensing orifice may help enhance the desired shape of the gel dollop 39. For example, for the star-shape dollop 39, aligning the partition wall 22 with a valley 67 as opposed to a peak 69 can help to form a more defined star shape for the gel dollop 39. But it is also contemplated that the partition wall 22 could be aligned with a peak 69 in the dispensing orifice to provide a different dollop configuration.

Figure 7:
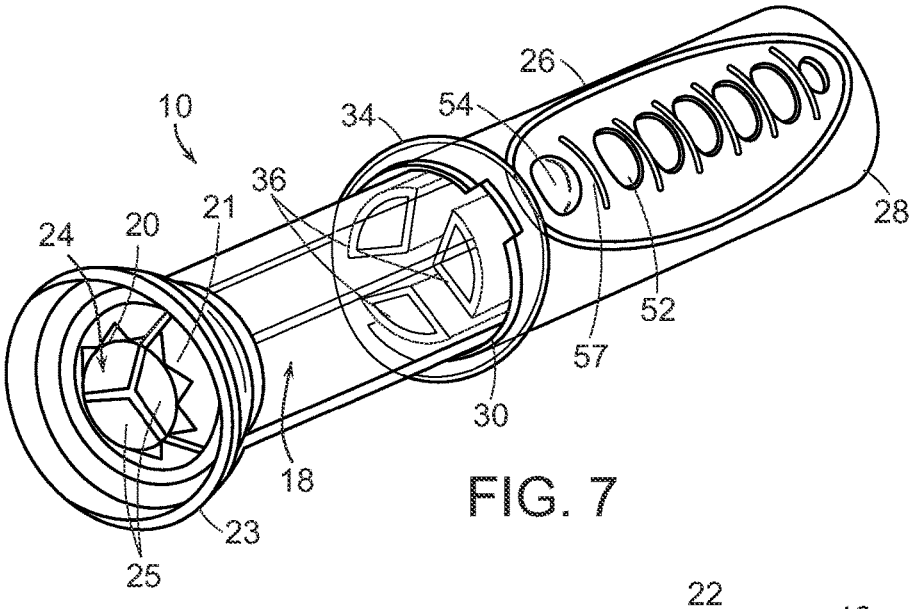
FIG. 7 is a front perspective view of an alternative embodiment of the dispenser of FIG. 1.
Figure 8:
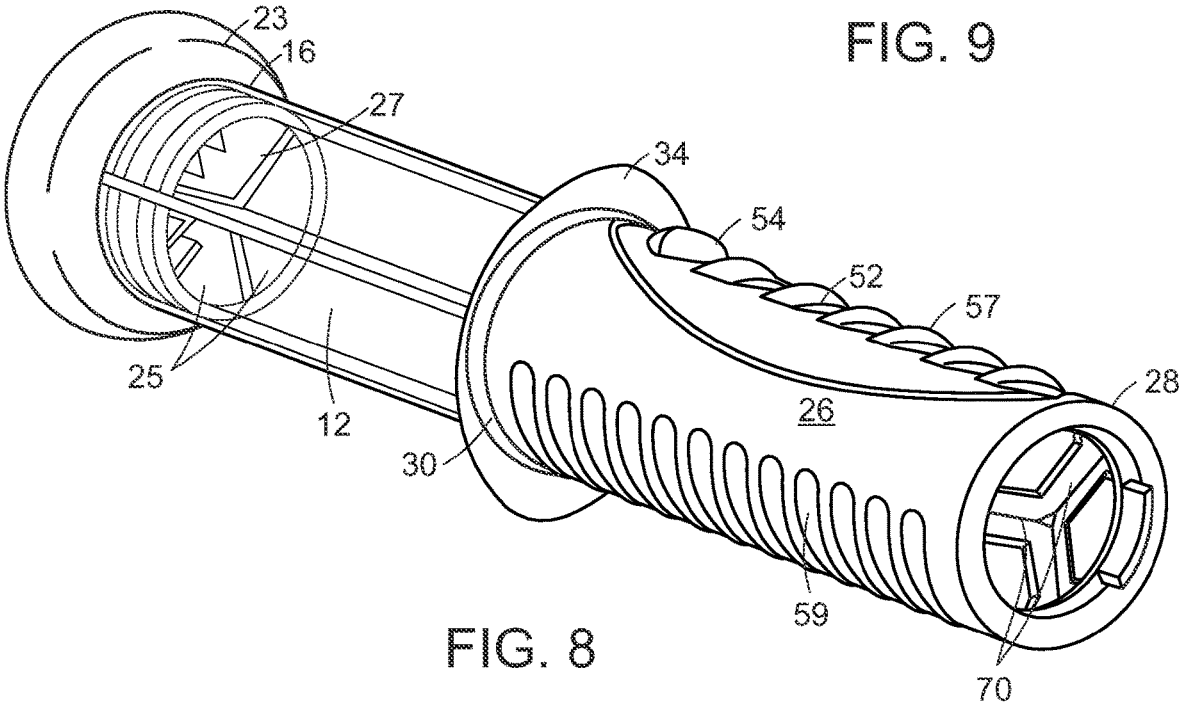
FIG. 8 is a rear perspective view of the alternative embodiment of FIG. 7

An alternative embodiment is illustrated in FIGS. 7, 8. This embodiment is similar to the embodiment of FIGS. 1, 2 above except that tube 12 is provided with three chambers 24 instead of two. In this embodiment, a dollop 39 formed of three different gels is formed (not shown). It is to be appreciated that each of the three gels may be formed of a different material and a different color. Each material could serve a different purpose, such as disinfecting, cleaning, or fragrancing, for example.

Figure 9:
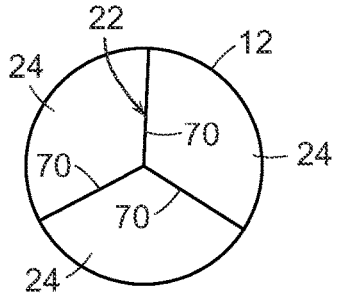
FIG. 9 is an elevation view of a proximal end of the tube of the dispenser of FIG. 7.

In this embodiment, as best seen in FIG. 9, dividing wall 22 in interior cavity 18 of tube 12 includes three portions 70, thereby forming three chambers 24 having pie slice or wedge shapes. Each of the three chambers 24 forms approximately a third of tube interior cavity, and they all have substantially the same size. As shown in FIG. 9, the portions 70 of the dividing wall 22 are positioned at approximately 120 degrees from each other.

Similarly, three pistons 25 may be received in corresponding chambers 24 in tube interior cavity 18. Each piston 25 may be pie slice shaped like chambers 24. It is to be appreciated that in FIGS. 7, 8 pistons 25 are shown proximate distal end 16 of tube 12 in abutting relationship with end wall 21, in a condition where all of the gels have been completely dispensed through orifice 20. Further, in FIGS. 7, 8 handle 26 is seen in a retracted position with respect to tube 12 and pistons 25.

It can be seen that in this embodiment handle 26 includes three pusher bars or plungers 36 that are configured to engage the three pistons 25 when tube 12 and handle 26 are in sliding engagement.

It is contemplated that the three chambers could be formed of different sizes and different shapes as discussed herein, and the pistons and pusher bars could be similarly shaped and sized according to the shapes of the chambers. For instance it may be desired to dispense a greater amount of a gel of a particular color, fragrance, cleaning efficacy, etc. than the other gels. Additionally, although only two and three combination gels are discussed herein, it is contemplated that more than three gels could be used in combination with each other by reconfiguring the dispenser.

Also other methods and configurations of metered dispensing are contemplated. For instance the guide pin can be formed of different shapes and sizes to provide an adequate feel and indication to the user that the next position has been reached on the dispenser. Also the guide pin can engage cutouts or notches that are entirely within the handle so the pin and cutouts or notches are not visible to the user. But the hidden internal notches and cutouts can still provide a tactile feedback to the user so that the user understands how much of the gel to dispense. Also other types of ratcheting mechanisms and/or guide tracks could be employed for indicating the next position to the user. For example, those shown in U.S. Pat. No. 7,520,406 incorporated by reference herein.

Alternatively, threads could be added to the handle and tube, in which case the dividers and pusher bars could be formed helical. The threads could vary in shape and size to provide a tactile feel to the user as the user rotates the dispenser thereby indicating to the user that the appropriate amount of gel has been dispensed. Also it is contemplated that the guide pin and the apertures be omitted, in which case no metering of the dispensed portions would occur. And where the guide pin and apertures are omitted, the tube 12 can be positioned in the handle 26 in two positions 180 degrees or three positions 120 degrees from each other.

Figure 10:
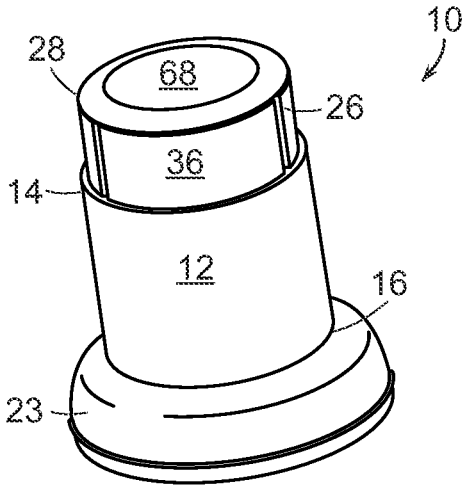
FIG. 10 is a perspective view of an alternative embodiment of the dispenser of FIG. 1, shown in a full condition.
Figure 11:
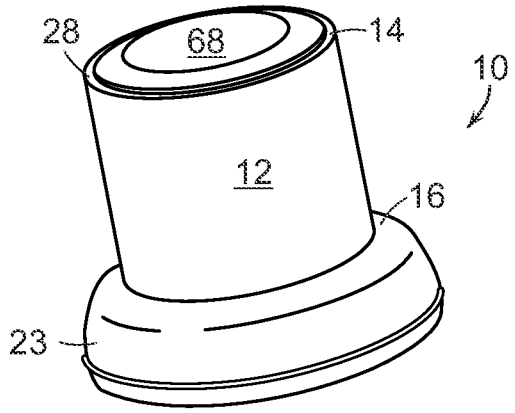
FIG. 11 is a perspective view of the dispenser of FIG. 10, shown in an empty condition.
Figure 12:
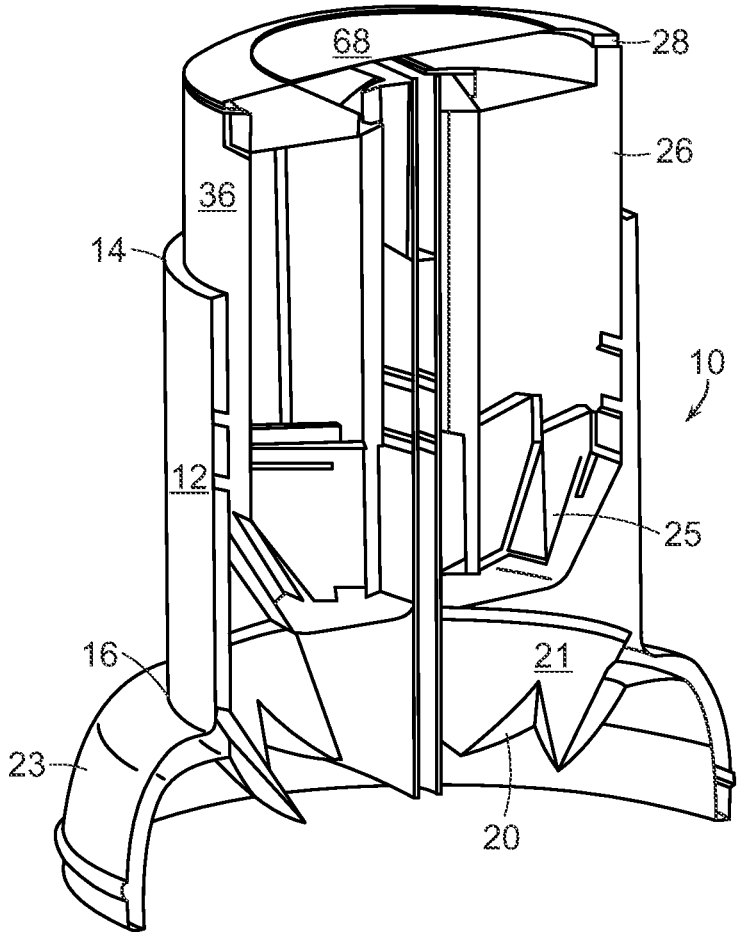
FIG. 12 is a section view of the dispenser of FIG. 10.
Figure 13:
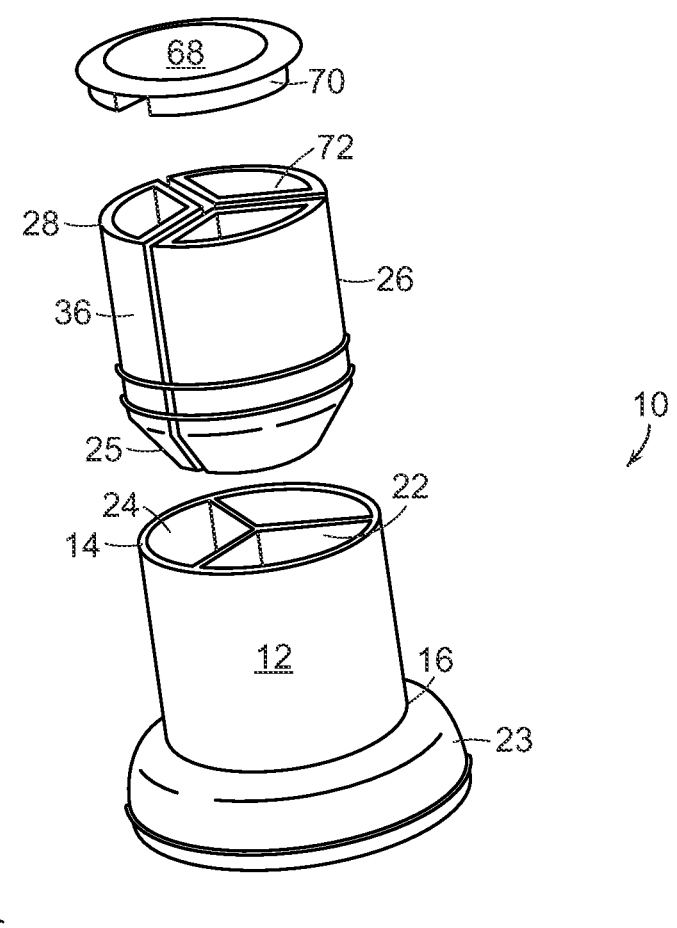
FIG. 13 is an exploded view of the dispenser of FIG. 10.

Another embodiment of dispenser 10 is illustrated in FIGS. 10-13. In this embodiment, a single dollop 39 of gel can be dispensed from dispenser 10. As seen in FIGS. 10-12, handle 26 is received in tube 12 when tube 12 and handle 26 move coaxially with respect to one another as the gel is dispensed from chambers 24 of tube 12. To dispense the gel within chambers 24 in tube 12, a proximal end of handle 26 may be depressed by the user's thumb such that handle 26 moves into tube 12. FIG. 10 illustrates dispenser 10 where the tube 12 is in a full condition, where proximal end 28 of handle 26 is positioned axially outwardly from proximal end 14 of tube 12. In the full condition, chambers 24 of interior cavity 18 include enough gel to form a single dollop 39. FIG. 11 illustrates dispenser 10 in an empty condition, where proximal end 28 of handle 26 has been depressed to a position where it is flush with proximal end 14 of tube 12.

In the embodiment illustrated in FIGS. 10-13, a cap 68 may be positioned at proximal end 28 of handle 26, and the user would press on cap 28 to dispense the gel from tube 12. In certain embodiments, cap 68 may be depressed by the user's thumb. As seen best in FIG. 13, cap 68 may include a plurality of projections 70, each of which may be received in an open end 72 of a corresponding pusher bar 36 at proximal end 28 of handle 26. Cap 68 may serve to keep pusher bars 36 aligned radially and axially as handle 26 and tube 12 move coaxially together. Additionally, cap 68 may help to distribute pressure from the user's thumb across all of the pusher bars 36. It is contemplated that the projections 70 of the cap 68 can be secured in the open ends 72 of the pusher bars 36 by any suitable method including press or interference fits, adhesives, etc., and the cap 68 may be integrally formed with the pusher bars 36.

Figure 2:
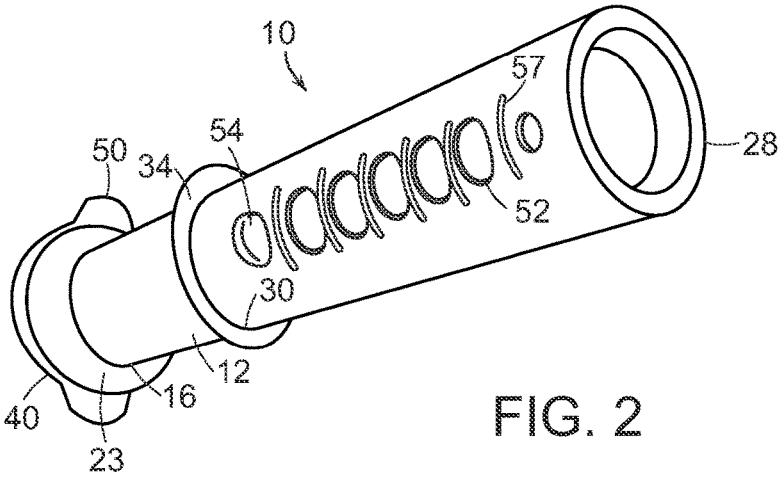
FIG. 2 is a perspective view of the dispenser of FIG. 1.

In this embodiment, pusher bars 36 and pistons 25 may be of unitary construction. That is, pusher bars 36 and pistons 25 are an integral, monolithic element of one-piece construction, as contrasted with the embodiment illustrated in FIG. 1, where pusher bars 36 and pistons 25 are separate elements that are engaged with one another when dispenser 10 is in an assembled condition, as seen in FIGS. 2, 7, and 8.

Those having skill in the art, with the knowledge gained from the present disclosure, will recognize that various changes can be made to the disclosed apparatuses and methods in attaining these and other advantages, without departing from the scope of the present invention. As such, it should be understood that the features described herein are susceptible to modification, alteration, changes, or substitution. For example, it is expressly intended that all combinations of those elements and/or steps which perform substantially the same function, in substantially the same way, to achieve the same results are within the scope of the invention. Substitutions of elements from one described embodiment to another are also fully intended and contemplated. The specific embodiments illustrated and described herein are for illustrative purposes only, and not limiting of the invention as set forth in the appended claims. Other embodiments will be evident to those of skill in the art. It should be understood that the foregoing description is provided for clarity only and is merely exemplary. The spirit and scope of the present invention are not limited to the above examples, but are encompassed by the following claims. All publications and patent applications cited above are incorporated by reference in their entirety for all purposes to the same extent as if each individual publication or patent application were specifically and individually indicated to be so incorporated by reference.

INDUSTRIAL APPLICABILITY

The disclosure relates to a device for accurately applying controlled unitized doses of a flowable adhesive material to a surface. In one use, the device may be used for applying controlled doses of a cleaning, disinfecting and/or fragrancing adhesive gel to the surface of a toilet, urinal, bathtub, shower, or any other hard surface. But it is contemplated that the doses could be applied to any surface desired to be cleaned.

Clauses

1. A dispenser for flowable materials comprising:
   a tube having a tube interior cavity, an open proximal end, and a distal end having a dispensing orifice;
   a dividing wall extending along the tube interior cavity and dividing the tube into a plurality of chambers;
   a first flowable material positioned in a first of the chambers;
   at least one additional flowable material positioned in another of the chambers;
   a plurality of pistons, each piston seated in a proximal end of one of the chambers; and
   a handle having a plurality of pusher bars, each pusher bar being configured to move one of the pistons,
   wherein when one of the tube and the handle is received in the other of the tube and the handle, the tube and handle move coaxially with respect to one another, and the pistons force the flowable materials from each of the chambers out of the dispensing orifice.
2. The dispenser of clause 1, wherein the first flowable material has a first color, and the at least one additional flowable material has a color that is different than the first color.
3. The dispenser of clause 1, wherein the flowable materials are each one of cleaning, disinfecting, or fragrancing adhesive gels.
4. The dispenser of clause 1, wherein the dividing wall divides the tube interior cavity into chambers of approximately the same size.
5. The dispenser of clause 1, wherein the dividing wall divides the tube interior cavity into two chambers.
6. The dispenser of clause 5, wherein the chambers and the pistons are substantially hemispherical.
7. The dispenser of clause 1, wherein the dividing wall includes three portions that divide the tube interior cavity into three chambers.
8. The dispenser of clause 7, wherein the first flowable material has a first color, a second flowable material has a second color that is different than the first color, and a third flowable material has a third color that is different than the first color and the second color.
9. The dispenser of clause 1, further comprising:
   a series of apertures formed along the handle; and
   a guide pin extending outwardly from an exterior surface of the tube and configured to be sequentially received in the apertures as the tube and handle move coaxially with respect to one another.
10. The dispenser of clause 9, further comprising a slot formed in the tube and defining a cutout tab, the guide pin extending outwardly from the cutout tab.
11. The dispenser of clause 10, wherein the slot is substantially U-shaped.
12. The dispenser of clause 1 further comprising a plurality of ribs formed on an exterior of the handle.
13. The dispenser of clause 1, further comprising a plurality of grooves formed in an exterior surface of the handle.
14. The dispenser of clause 1, further comprising a cap removably securable to the distal end of the tube.
15. The dispenser of clause 14, wherein the cap includes a pair of opposed ears.
16. The dispenser of clause 1, further comprising an end wall at the distal end of the tube, the orifice being formed in the end wall.
17. The dispenser of clause 1, wherein the dispensing orifice is star shaped.
18. The dispenser of clause 1, wherein a periphery of the dispensing orifice is formed with a plurality of convex segments.
19. The dispenser of claim clause 1, wherein the tube is substantially cylindrical.
20. The dispenser of clause 1, wherein the handle has a handle: interior cavity that receives the tube.
21. The dispenser of clause 1, wherein the pusher bars and the pistons are of unitary construction.
22. The dispenser of clause 1, further comprising a cap seated on an end of the handle.
23. The dispenser of clause 1, wherein the tube interior cavity contains enough first flowable material and second flowable material to dispense only a single dollop of flowable materials out of the dispensing orifice.
24. The dispenser of clause 1, wherein the dispensing orifice comprises a series of peaks and valleys and wherein the valleys are aligned with the dividing wall.
25. A dispenser for flowable materials comprising:
   a substantially cylindrical tube having an interior cavity, an open proximal end and a distal end having a dispensing orifice;
   a dividing wall positioned in the tube and connected along opposed sides thereof to an interior surface of the tube and dividing the tube into a plurality of chambers;
   a first flowable material having a first color and positioned in a first of the chambers;
   at least one additional flowable material having another color different than the first color and positioned in another of the chambers;
   a plurality of pistons, each piston slidingly positioned in a proximal end of one of the chambers; and
   a handle having a proximal end, and open distal end, a handle interior cavity that receives the tube, and a plurality of pusher bars, each pusher bar connected to the proximal end of the handle and having a free distal end, the distal end engaging one of the pistons,
   wherein when the tube is received in the handle and the tube and handle move coaxially with respect to one another, the pistons force the flowable materials from each of the chambers out of the dispensing orifice.
26. The dispenser of clause 25, wherein the flowable materials are each one of cleaning, disinfecting, and/or fragrancing adhesive gels.
27. The dispenser of clause 25, wherein the dividing wall divides the tube interior cavity into two chambers.
28. The dispenser of clause 25, wherein the dividing wall divides the tube interior cavity into chambers of approximately the same size.
29. The dispenser of clause 25, wherein the dividing wall includes three portions that divides the tube interior cavity into three chambers.
30. The dispenser of clause 29, wherein a second flowable material has a second color that is different than the first color, and a third flowable material has a third color that is different than the first color and the second color.
31. The dispenser of clause 29, wherein a cross section of the interior cavity forms three sections that are pie shaped.
32. The dispenser of clause 25, further comprising:
   a series of apertures formed in a row along the handle; and
   a guide pin extending outwardly from an exterior surface of the tube and configured to be sequentially received in the apertures as the tube and handle move coaxially with respect to one another.

33. The dispenser of clause 32, further comprising a slot formed in the tube and defining a cutout tab, the guide pin extending outwardly from the cutout tab.

34. The dispenser of clause 33, wherein the slot is substantially U-shaped.

35. The dispenser of clause 25, further comprising a plurality of ribs formed on an exterior of the handle.

36. The dispenser of clause 25, further comprising a plurality of grooves formed in an exterior surface of the handle.

37. The dispenser of clause 25, further comprising a cap removably securable to the distal end of the tube.

38. The dispenser of clause 37, wherein the cap includes a pair of opposed ears.

39. The dispenser of clause 25, wherein a periphery of the dispensing orifice is formed with a plurality of convex segments.

40. The dispenser of clause 25, wherein the dispensing orifice comprises a series of peaks and valleys and wherein the valleys are aligned with the divider wall.

The invention claimed is:

1. A dispenser for flowable materials comprising:

a tube having a tube interior cavity, an open proximal end, and a distal end having a dispensing orifice;

a dividing wall extending along the tube interior cavity and including three portions that divide the tube interior cavity into three chambers, wherein the three chambers are formed of different sizes and different shapes;

a first flowable material positioned in a first chamber, a second flowable material positioned in a second chamber, and a third flowable material positioned in a third chamber, wherein the first flowable material has a first color, the second flowable material has a second color that is different than the first color, and the third flowable material has a third color that is different than the first color and the second color, wherein each material serves a different purpose;

a plurality of pistons, each piston seated in a proximal end of one of the chambers and having a recess formed in a proximal end thereof; and a handle having a plurality of pusher bars, each pusher bar having a free end shaped to mate with a shape of a corresponding recess in one of the pistons and being configured to be received in and engage with the corresponding recess to move the one of the pistons, wherein when one of the tube and the handle is received in the other of the tube and the handle, the tube and handle move coaxially with respect to one another, and the pistons force the flowable materials from each of the chambers out of the dispensing orifice.

2. The dispenser of claim 1, wherein the flowable materials are each one of cleaning, disinfecting, or fragrancing adhesive gels.

3. The dispenser of claim 1, further comprising:

a series of apertures formed along the handle; and a guide pin extending outwardly from an exterior surface of the tube and configured to be sequentially received in the apertures as the tube and handle move coaxially with respect to one another.

4. The dispenser of claim 3, further comprising a slot formed in the tube and defining a cutout tab, the guide pin extending outwardly from the cutout tab.

5. The dispenser of claim 1 further comprising a plurality of ribs formed on an exterior of the handle.

6. The dispenser of claim 1, further comprising a cap removably securable to the distal end of the tube.

7. The dispenser of claim 1, further comprising an end wall at the distal end of the tube, the orifice being formed in the end wall.

8. The dispenser of claim 1, wherein the handle has a handle interior cavity that receives the tube.

9. The dispenser of claim 1, wherein the tube interior cavity contains enough first flowable material, second flowable material, and third flowable material to dispense only a single dollop of flowable materials out of the dispensing orifice.

10. The dispenser of claim 1, wherein the dispensing orifice comprises a series of peaks and valleys and wherein the valleys are aligned with the dividing wall.

11. A dispenser for flowable materials comprising:

a substantially cylindrical tube having a tube interior cavity, an open proximal end and a distal end having a dispensing orifice;

a dividing wall positioned in the tube and connected along opposed sides thereof to an interior surface of the tube and including three portions that divide the tube interior cavity into three chambers, wherein the three chambers are formed of different sizes and different shapes;

a first flowable material positioned in a first chamber, a second flowable material positioned in a second chamber, and a third flowable material positioned in a third chamber, wherein the first flowable material has a first color, the second flowable material has a second color that is different than the first color, and the third flowable material has a third color that is different than the first color and the second color, wherein each material serves a different purpose;

a plurality of pistons, each piston slidingly positioned in a proximal end of one of the chambers and having a recess formed in a proximal end thereof; and a handle having a proximal end, an open distal end, a handle interior cavity that receives the tube, and a plurality of pusher bars, each pusher bar connected to the proximal end of the handle and having a free distal end, the free distal end having a shape that mates with a shape of a corresponding recess in one of the pistons and configured to be received in and engage with the corresponding recess to move the one of the pistons, wherein when the tube is received in the handle and the tube and handle move coaxially with respect to one another, the pistons force the flowable materials from each of the chambers out of the dispensing orifice.

12. The dispenser of claim 11, wherein the flowable materials are each one of cleaning, disinfecting, and/or fragrancing adhesive gels.

13. The dispenser of claim 11, further comprising:

a series of apertures formed in a row along the handle; and a guide pin extending outwardly from an exterior surface of the tube and configured to be sequentially received in the apertures as the tube and handle move coaxially with respect to one another.

14. The dispenser of claim 13, further comprising a slot formed in the tube and defining a cutout tab, the guide pin extending outwardly from the cutout tab.

15. The dispenser of claim 11, further comprising a plurality of ribs formed on an exterior of the handle.

16. The dispenser of claim 11, further comprising a cap removably securable to the distal end of the tube.

17. The dispenser of claim 11, wherein the dispensing orifice comprises a series of peaks and valleys and wherein the valleys are aligned with the divider wall.

* * * * *